United States Patent [19]

Kelly et al.

[11] 4,447,005

[45] May 8, 1984

[54] DOUBLE DOOR SECURITY RURAL MAILBOX WITH AUTOMATIC SIGNALLING MEANS

[76] Inventors: James B. Kelly; Viola F. Kelly, both of 7255 Shelby St., Indianapolis, Ind. 46227

[21] Appl. No.: 478,642

[22] Filed: Mar. 25, 1983

[51] Int. Cl.[3] ..... B65D 91/00

[52] U.S. Cl. ..... 232/35; 232/41 D; 232/45; 232/43.4

[58] Field of Search ..... 232/34, 35, 37, 38, 232/27, 23, 17, 43.1, 43.4, 45, 41 D

[56] References Cited

U.S. PATENT DOCUMENTS

| | | | |
|---|---|---|---|
| 627,635 | 6/1899 | Bates | 232/35 |
| 924,651 | 6/1909 | Farrar | 232/35 |
| 1,478,552 | 12/1923 | Chapman | 232/41 D |
| 1,920,813 | 8/1933 | Storms | 232/41 D |
| 3,106,335 | 10/1963 | Allan | 232/34 |
| 3,758,027 | 9/1973 | Morgan | 232/43.1 |
| 3,891,139 | 6/1975 | Redling | 232/35 |
| 4,005,816 | 2/1977 | Malik | 232/35 |
| 4,220,278 | 9/1980 | Hasselbring | 232/35 |
| 4,382,540 | 5/1983 | Kelly et al. | 232/17 |

*Primary Examiner*—Robert Peshock
*Assistant Examiner*—Kris R. Schulze
*Attorney, Agent, or Firm*—Woodard, Weikart, Emhardt & Naughton

[57] ABSTRACT

A mailbox having a mail carrier door and an owner's door with a signal flag moveably mounted thereatop to indicate the presence or absence of mail therein. A mechanism within the mailbox has a pair of slidable members mounted to a downwardly extending bracket with a flag rod extending through each member and moveable thereby. A pair of springs urge the first member toward the mail carrier door and the second member against the owner's door. A pivotable extension mounted to the mail carrier door is engaged by the mechanism to prevent opening thereof until the owner's door is open allowing the second member to slide therethrough releasing the extension.

15 Claims, 7 Drawing Figures

DOUBLE DOOR SECURITY RURAL MAILBOX WITH AUTOMATIC SIGNALLING MEANS

BACKGROUND OF THE INVENTION

This invention is in the field of mailboxes and more specifically those mail depositories having a pair of opposite doors with an automatic signalling device for indicating presence of mail. In my co-pending U.S. Patent application, Ser. No. 168,126, filed July 14, 1980, I disclose a double door security mailbox having oppositely opening front and rear doors. The mailbox includes a mechanism allowing the front door to be freely opened and closed once by the mail carrier before securing in a locked position. Thereafter, the front door may be unlocked only by opening the rear door. In order to provide yet a more convenient and automatic mailbox as compared to my aforementioned mailbox, I have designed and disclosed herein an automatic signalling device mounted atop the mailbox which will automatically signal whether mail is present within the box. The signalling device is automatically positioned depending upon the opening and closing of the front and rear door to the mailbox.

A number of mailboxes have been designed having a variety of signalling devices mounted thereon. For example, in U.S. Pat. No. 4,290,549, issued to Getz, Jr., there is disclosed a single door mailbox with a manually resettable pair of signal flags. U.S. Pat. No. 4,202,486, issued to Tipsword also discloses a single door mailbox with a signal flag not adapted for use with a security locking mechanism. A further device is disclosed in U.S. Pat. No. 3,758,027, issued to Morgan having a double door mailbox with a manually operated signal flag. Another double door mailbox is disclosed in U.S. Pat. No. 4,005,816 to Malik which provides a signal flag actuating mechanism; however, the signal flat actuating mechanism with a security mechanism is not disclosed. Two additional signal flag mechanisms are shown in U.S. Pat. Nos. 3,891,139 to Redling and 4,220,278 to Hasselbring, neither disclosing a signal flag actuating mechanism in conjunction with a security locking mechanism.

My signal flag actuating mechanism as compared to the aforementioned devices is completely automatic and is integrally connected to and operates with the security locking mechanism preventing unauthorized opening of the front door of the mailbox once the mail is deposited therein. The owner, simply by removing the mail through the rear door of the mailbox, automatically positions the signal flag to indicate the box is empty whenever the rear door is opened. As a result, the mailbox disclosed herein is particularly advantageous as compared to the prior art.

SUMMARY OF THE INVENTION

One embodiment of the present invention is a mailbox comprising a mailbox main body with a mail carrier door and owner's door, a signal flag mounted to the main body and moveable to a first position associated with the mail being in the main body and to a second position associated with the main body being empty of mail, and means operatively associated with the mail carrier door and owner's door and first operable to lock the mail carrier door once opened and closed until the owner's door is opened, and further operatively associated with the signal flag to move the signal flag to the first position when the mail carrier door is opened and to the second position when the owner's door is opened.

It is an object of the present invention to provide a new and improved double door security rural mailbox.

A further object of the present invention is to provide a mailbox having an automatic signalling device for indicating presence of mail within the mailbox.

Yet another object of the present invention is to provide a security mailbox with a locking mechanism integrally incorporated into the automatic signalling mechanism.

In addition, it is an object of the present invention to provide a double door security rural mailbox with an automatic signalling device.

Related objects and advantages of the present invention will be apparent from the following description.

DESCRIPTION OF THE PREFERRED EMBODIMENT

Figure 1:
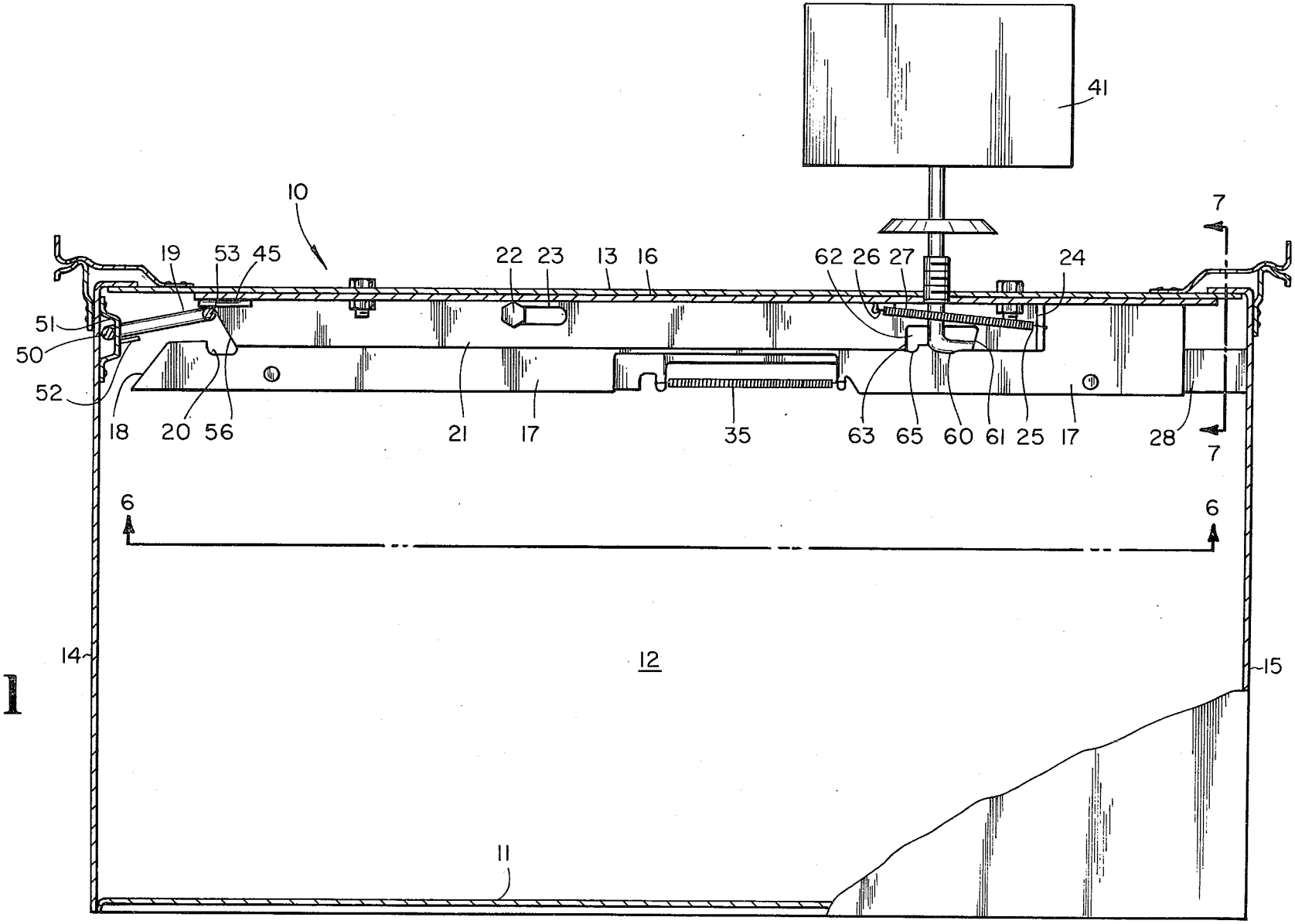
FIG. 1 is a fragmentary cross-sectional view of a mailbox incorporating the present invention and showing both doors closed and without the mailbox having any mail therein.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a fragmentary cross-sectional view of a rural mailbox 10 having a conventional housing main body with a flat bottom wall 11 connected to a pair of oppositely positioned side walls 12 connected together via a rounded top wall 13. A front door 14 and back door 15 are hingedly mounted at their bottom ends to the opposite ends of bottom wall 11. Further, a pair of conventional clasps are mounted to the top ends of doors 14 and 15 and at the opposite ends of top wall 13 to removably secure the doors in the closed position. A conventional key lock is mounted to the rear door 15 to lock the door in the closed position and is not shown in order that the security and signal flag positioning mechanism may be more clearly illustrated. The key lock mounted to the rear door 15 is conventional in construction and operation. Suffice it to state, that rear door 15 will not open until the appropriate key is inserted into the lock and the door is unlocked. A conventional red flag is mounted to one of the side walls 12 and is not shown for purposes of clarity. The side mounted flag is manually positioned by the owner to indicate to the mail carrier the presence of mail being deposited therein by the owner for pickup by the mail carrier.

Figure 7:
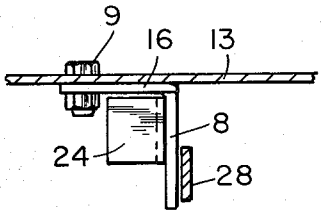
FIG. 7 is a cross-sectional view taken along the lines 7—7 of FIG. 1 and viewed in the direction of the arrows.

Fixedly mounted to top wall 13 is an inverted L-shaped bracket 8 (FIG. 7) which is secured to the top wall by conventional fastening devices 9. Bracket 8 has a horizontally extending leg 16 fixedly mounted to top wall 13 and a downwardly extending leg 17 integrally joined to leg 16. The forward edge 18 is inclined upwardly to guide a U-shaped rod 19 mounted to the front door 14 as will be described later herein. A rod receiving cavity 20 is also provided in the forward end portion of leg 17 to receive one of the ends of the U-shaped rod 19 depending upon the position of the front door.

A signal flag actuator bar 21 is slidably mounted to the vertical leg 17 of bracket 8 and may be reciprocated in a horizontal direction. A headed fastener 22 is fixedly mounted to leg 17 and extends freely through slot 23 provided in actuator bar 21 thereby limiting the forward and rearward motion of bar 21. Bar 21 includes a rear flange 24 having one end 25 of a helical spring 27 secured thereto. The opposite end 26 of the helical spring is fixedly attached to the horizontal leg 16 of bracket 8. Thus, helical spring 27 is operable to urge bar 21 normally toward front door 14.

Figure 2:
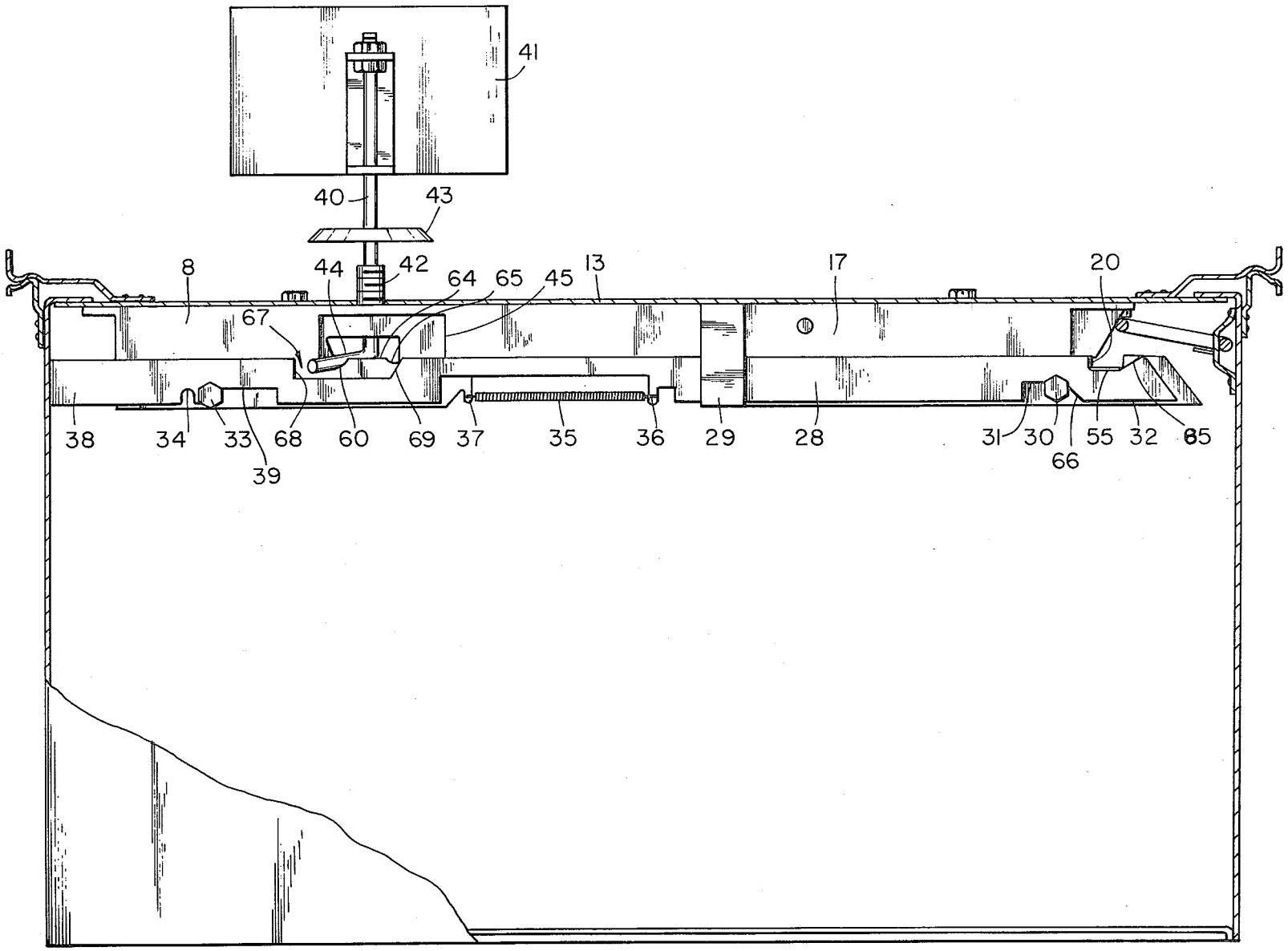
FIG. 2 is the same view as FIG. 1 only showing the opposite side of the mechanism illustrated in FIG. 1 to secure the front door while positioning the signal flag.

A slide cam member 28 is also mounted to vertical leg 17 on the side opposite of the side upon which bar 21 is mounted. Referring to the opposite side view of the mechanism as shown in FIG. 2, slide cam member 28 is positioned between vertical leg 17 and a downwardly extending bracket 29 fixedly mounted to bracket 8 but spaced therefrom to allow movement of member 28 therebetween. A headed fastener 30 is fixedly mounted to vertical leg 17 and is positioned at all times either within recess 31 or immediately beneath and adjacent bottom edge 32 of member 28. Likewise, a second headed fastener 33 fixedly attached to vertical leg 17 is positioned at the rear end portion of member 28 and is positioned with recess 33 or 39. A helical spring 35 has one end 36 fixedly attached to member 28 and an opposite end 37 fixedly attached to vertical leg 17. Thus, helical spring 35 is operable to normally urge member 28 rearwardly so that the rear edge portion 38 of member 28 contacts the rear door 15 of the mailbox.

A pivotable signal flag is mounted to the top wall of the mailbox and is operable in conjunction with the mechanism previously described to indicate the presence or lack thereof of mail within the mailbox. The signal flag includes a vertical rod 40 fixedly attached by conventional means to a plate member 41 of red or other suitable color. Rod 40 extends freely through an externally threaded mounting cylinder 42 fixedly secured to the top wall 13 of the mailbox. A disc shaped plate 43 mounted to rod 40 prevents leakage of rain water down the rod, through cylinder 42 and into the mailbox. The bottom end 44 is formed at right angles to the vertical portion of rod 40 and extends freely through aperture 45 provided in leg 17 to engage bar 21 and member 28 as the front and rear doors are opened and closed thereby automatically positioning the flag.

Pivotally mounted to the inside surface of the front door 14 is the U-shaped rod 19. The forward leg 50 (FIG. 1) of rod 19 is pivotally mounted by bracket 51 to door 14 with bracket 51 having a suitable stop surface 52 to prevent rod 19 from pivoting completely down so as to not engage leg 17 as the door is closed. A conventional magnet 54 is mounted beneath and to horizontal leg 16 of the bracket and is operable to hold leg 53 of the U-shaped rod 19 when the door is closed as shown in FIG. 1.

Bar 21 is provided with an opening 62 having a forward edge 63 and rearward edge 61 through which the bottom portion 44 of flag rod 40 projects. Likewise, opening 45 of leg 17 includes a bottom edge 64 having a pair of recesses 65 and 60 formed therein to receive the horizontally extending bottom portion 44 of the flag rod. The function of the forward edge 63, the rearward edge 61, as well as recesses 65 and 60 will be described as the operation of the mailbox is disclosed hereinafter. Member 28 has an upwardly opening recess 67 with a rearward edge 68 and inclined upward edge 69 for contacting and operating the flag rod.

The operation of the mailbox will now be described starting from the position shown in FIG. 1 with both doors closed and without mail being located therein. Initially, the rear edge of member 28 abuts the inside surface of rear door 15. The U-shaped rod 19 is in the upward position with leg 53 being secured to magnet 45. Rod recess 55 (FIG. 2) of member 28 is aligned with recess 20 with the helical spring 35 urging member 28 rearwardly. On the other hand, helical spring 27 urges bar 21 forwardly so that the downwardly inclined front edge 56 of the bar contacts leg 53 of the U-shaped rod. Fastener 22 is located in the forward portion of slot 23. The automatic signal flag 41 is contained in a plane parallel to the longitudinal axis of the mailbox and thus the bottom end portion 44 of flag rod 40 is angled toward the rear door being positioned within recess 60 of vertical leg 17 and adjacent the rear edge 61 of opening 62 provided in bar 21.

Figure 3:
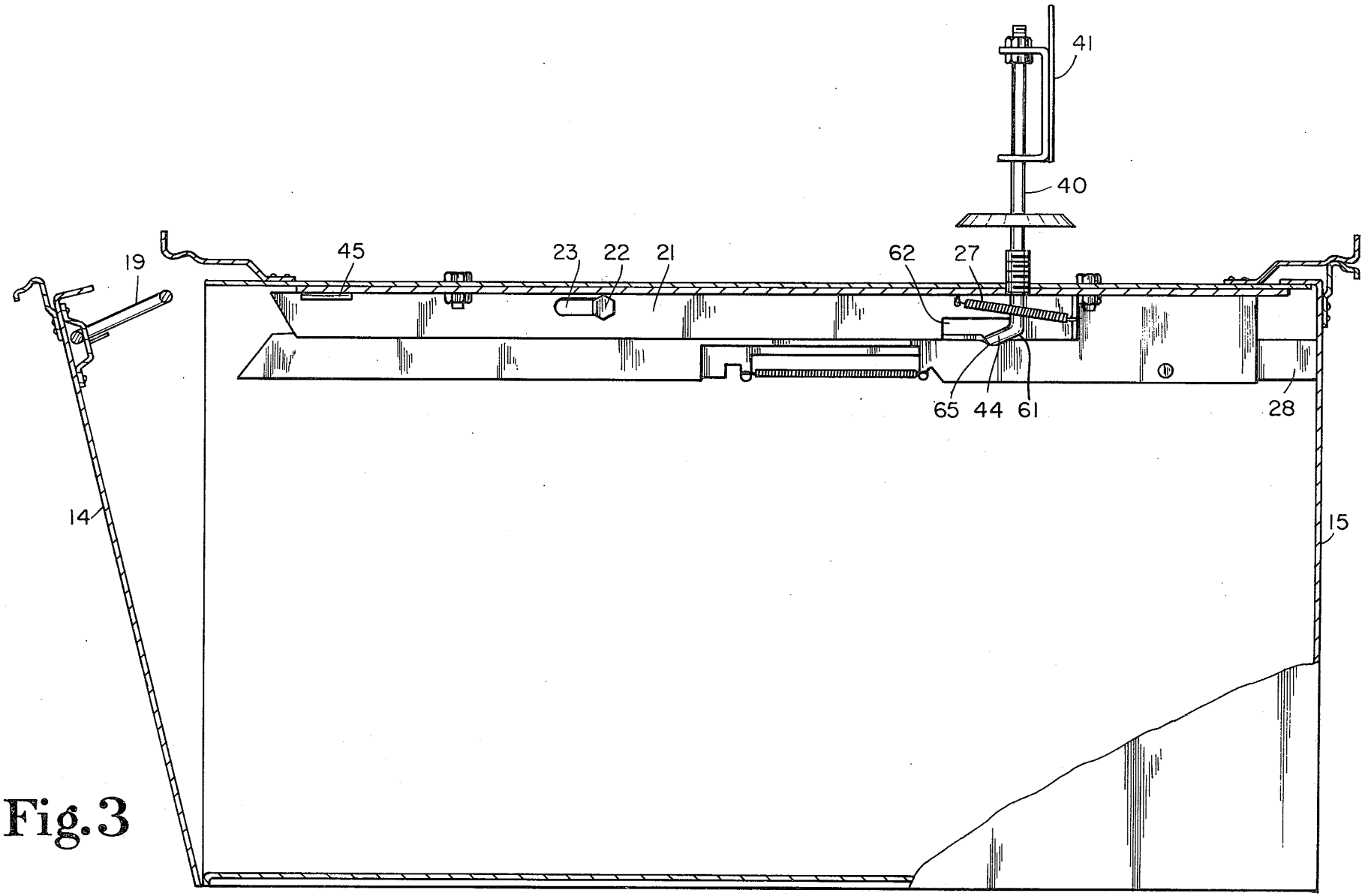
FIG. 3 is the same view as FIG. 1 only showing the front door being opened for insertion of mail therethrough.
Figure 4:
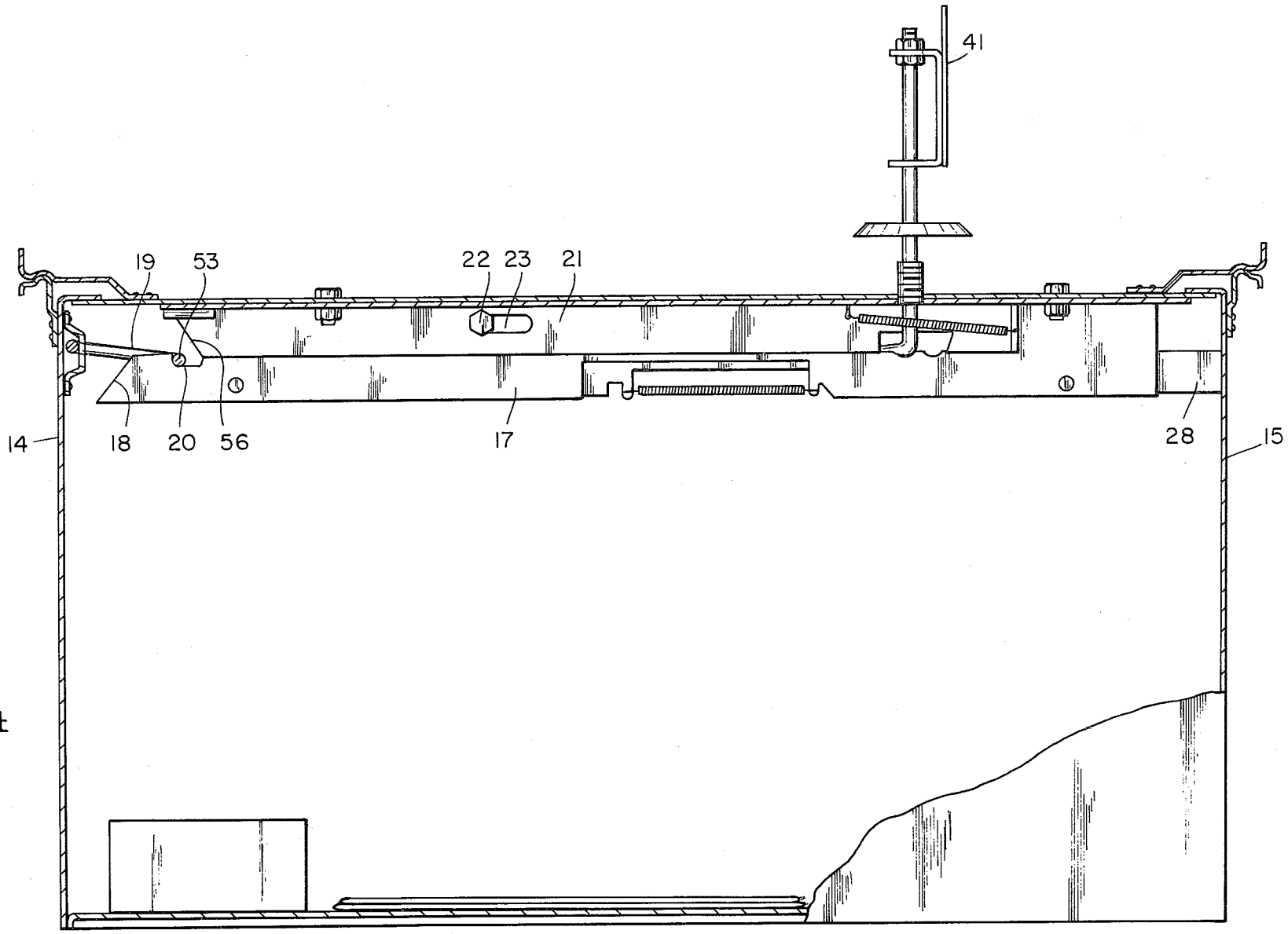
FIG. 4 is the same view as FIG. 3 only showing the doors closed and the mail located within the mailbox.

The mail carrier by opening front door 14 and inserting mail into the mailbox causes the slide mechanism to move and pivot the signal flag so that the flag plate member 41 is contained in a plane perpendicular to a longitudinal axis of the mailbox as shown in FIG. 3. As door 14 is opened, contact between the U-shaped rod 19 and magnet 45 is broken allowing spring 27 to force bar 21 forwardly until the headed member 22 contacts the rearward edge of slot 23. As bar 21 moves towards the front door, rear edge 61 of aperture 62 contacts the horizontally extending portion 44 of flag rod 40 thereby pivoting the flag from recess 60 to recess 65 of vertical leg 17. Once the mail is inserted into the mailbox, the mail carrier closes door 14 thereby forcing leg 53 of U-shaped rod 19 to ride up the inclined edge 18 of leg 17 and into recess 20 of leg 17 as shown in FIG. 4. Simultaneously, leg 53 of the U-shaped leg 19 contacts the downwardly inclined edge 56 of bar 21 forcing the bar rearwardly positioning headed fastener 22 in the forward end portion of slot 23.

Figure 5:
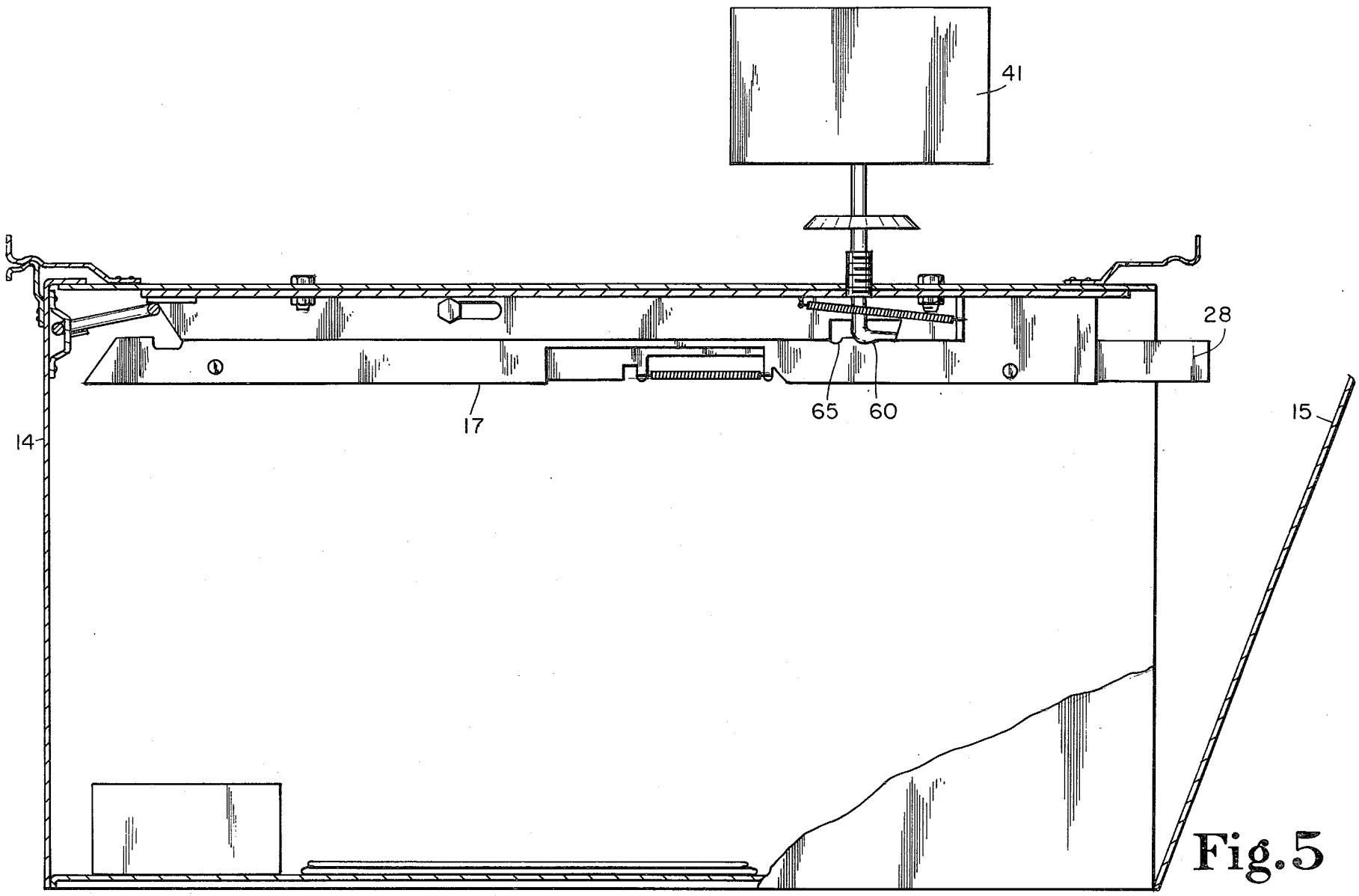
FIG. 5 is the same view as FIG. 4 only showing the rear door open for removal of the mail therethrough.
Figure 6:
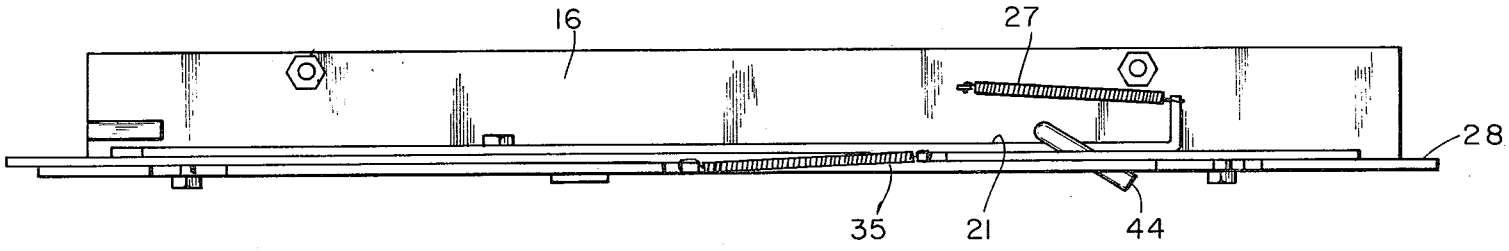
FIG. 6 is a bottom view of the mechanism looking in the direction of arrows 6—6 of FIG. 1.

With the signal flag indicating the presence of mail, the owner then unlocks and opens the rear door 15 (FIG. 5) thereby allowing member 28 to move rearwardly due to the force of helical spring 35. Rearward movement of member 28 causes the upward inclined edge 85 in recess 55 (FIG. 2) to contact leg 53 of the U-shaped rod thereby once again forcing the rod upwardly so that contact is made between magnet 45 and leg 53 thereby securing the U-shaped rod in the upward position. Simultaneously, the forward edge 66 of recess 31 (FIG. 2) rides on headed fastener 30 thereby positioning the headed fastener beneath edge 32 assisting in upward pivoting movement of member 28 and in turn upward movement of the U-shaped rod 19 until the magnet is attached to the U-shaped leg. Simultaneously, the upward inclined edge 69 of recess 67 (FIG. 2) contacts the horizontally extending bottom end portion 44 of the flag rod pivoting the plate member 41 to a plane once again parallel to longitudinal axis of the mailbox as shown in FIG. 5. Thus, bottom portion 44 of the flag rod is moved from recess 65 to recess 60 of vertical leg 17. Once the mail is removed by the owner, the rear door 15 is closed and locked thereby forcing member 28 to move toward the front door to the position shown in FIG. 1. At this time, the rearward edge 68 (FIG. 2) of member 28 contacts bottom portion 44 of the flag rod moving portion 44 from recess 60 to recess 65. Likewise, headed fastener 30 is once again positioned within recess 31.

It should be noted that the mechanism allows for repeated opening and closing of the rear door 15 while either moving or maintaining the flag member 41 in a plane parallel to longitudinal axis of the mailbox. The slide mechanism disclosed in the drawings does not impede repeated opening and closing of the rear door. On the other hand, the mechanism is designed to allow only a single opening of the front door with the door then being locked in place once closed until the rear door is opened. This is true since the leg 53 of the U-shaped rod is automatically positioned in recess 20 of vertical leg 17 once the front door is opened and then closed. The front door may then not be opened until the rear door is opened and closed resetting the mechanism. In certain instances, it may be desirable to position the slide mechanism in an inoperable condition. Thus, recess 34 is provided on member 28 (FIG. 2) and is positioned between recess 33 and the rear edge 38 of the member. Member 28 may be pivoted upwardly to position headed member 33 in recess 34 and thus making the slide mechanism inoperable. In such a case, the front and rear door may be opened and closed in the conventional manner.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. Another variation, for example, includes hinging the doors from the top in lieu of the bottom.

The invention claimed is:

1. A mailbox comprising:

a mailbox main body with a mail carrier door and owner's door;

a signal flag mounted external to said main body and moveable to a first position associated with mail being in said main body and to a second position associated with said main body being empty of mail;

first means operatively associated with said mail carrier door and owner's door and operable to lock said mail carrier door once opened and closed until said owner's door is opened; and second means operatively associated with said mail carrier door, said owner's door and said signal flag and interacting with said first means to move said signal flag to said first position when said mail carrier door is opened and to said second position when said owner's door is opened.

2. The mailbox of claim 1 wherein:

said first and second means include a common first member slidably mounted to said main body, said first member is normally biased against said owner's door and is moveable when said owner's door is open to move said signal flag to said second position.

3. The mailbox of claim 2 wherein said first and second means include a common second member slidably mounted to said main body, said second member is moveable when said mail carrier door is open to move said signal flag to said first position.

4. The mailbox of claim 3 wherein said first and second means include a common stationary member mounted to said main body with said stationary member including a stationary locking surface operatively engaged with said mail carrier door to limit opening thereof.

5. The mailbox of claim 4 wherein said mail carrier door includes a moveable arm engageable with said locking surface once said mail carrier door is opened and closed.

6. A mailbox comprising:

(a) a mailbox main body with a mail carrier door and owner's door;

(b) a signal flag mounted to said main body and moveable to a first position associated with mail being in said main body and to a second position associated with said main body being empty of mail; and (c) means operatively associated with said mail carrier door and owner's door and first operable to lock said mail carrier door once opened and closed until said owner's door is opened, and further operatively associated with said signal flag to move said signal flag to said first position when said mail carrier door is opened and to said second position when said owner's door is opened, said means including (1) a first member slidably mounted to said main body, said first member being normally biased against said owner's door and moveable when said owner's door is open to move said signal flag to said second position;

(2) a second member slidably mounted to said main body, said second member being moveable when said mail carrier door is open to move said signal flag to said first position; and (3) a stationary member mounted to said main body, said stationary member including a locking surface operatively engaged with said mail carrier door to limit opening thereof;

said mail carrier door including a moveable arm engageable with said locking surface once said mail carrier door is opened and closed;

said signal flag including a leg engageable by said first member and said second member;

said stationary member including a first recess and a second recess to receive said leg when said flag is positioned respectively in said first position and second position.

7. The mailbox of claim 6 wherein said main body includes a holding device to receive and hold said arm away from said locking surface when said signal flag is in said second position and each door is closed.

8. A mailbox apparatus comprising:

a mailbox with a front door and a rear door and a signal flag moveably mounted external thereto;

locking means mounted within said mailbox and operable to lock said front door closed once opened and closed; and signal flag operating means mounted within said mailbox and interacting with said locking means to position said flag to signal presence of mail in said mailbox.

9. The apparatus of claim 8 wherein said locking means and said signal flag operating means include a common bracket mounted to said mailbox, said apparatus further comprising a first member and second member slidably mounted to said common bracket.

10. A mailbox apparatus comprising:

a mailbox with a front door and a rear door; a signal flag moveably mounted thereto; and cooperative locking and signal flag operating means mounted within said mailbox and operable to both lock said front door closed once opened and closed and to position said flag to signal presence of mail in said mailbox, said means including a bracket mounted to said mailbox with a first member and second member slidably mounted thereto;

said flag including a rod extending into said mailbox and through said bracket, said rod being engaged by said first member and said second member to position said flag.

11. The apparatus of claim 10 wherein said means includes spring means connected to said first member and second member and operable to normally urge said first member towards said front door and said second member towards said rear door.

12. The apparatus of claim 11 wherein said front door has an extension thereon, said bracket includes a stop surface and a catch, either of which can hold said extension.

13. The apparatus of claim 12 wherein:

said first member includes a front edge moveable against said extension by said spring means to force said extension away from said catch as said front door is opened, said first member further includes a portion moveable against said rod by said spring means as said front door is open to move said rod and signal flag to a position indicating presence of mail within said mailbox.

14. The apparatus of claim 13 wherein:

said second member includes an edge portion operable to move said extension away from said stop surface and towards said catch as said rear door is open moving said second member away from said front door by the urging of said spring means;

said second member further includes a portion contactable against said rod to move said rod and said signal flag to a position indicating absence of mail in said mailbox as said rear door is open and said second member moves away from said front door.

15. The apparatus of claim 14 wherein:

said stop surface engages said extension limiting movement of said front door when each door is closed and said signal flag is in a position indicating presence of mail within said mailbox.

* * * * *